US010934985B2

(12) United States Patent
Sakai et al.

(10) Patent No.: US 10,934,985 B2
(45) Date of Patent: Mar. 2, 2021

(54) FUEL PUMP

(71) Applicant: DENSO CORPORATION, Kariya (JP)

(72) Inventors: Hiromi Sakai, Kariya (JP); Daiji Furuhashi, Kariya (JP)

(73) Assignee: DENSO CORPORATION, Kariya (JP)

( * ) Notice: Subject to any disclaimer, the term of this patent is extended or adjusted under 35 U.S.C. 154(b) by 473 days.

(21) Appl. No.: 15/542,758

(22) PCT Filed: Dec. 21, 2015

(86) PCT No.: PCT/JP2015/006357
§ 371 (c)(1),
(2) Date: Jul. 11, 2017

(87) PCT Pub. No.: WO2016/113813
PCT Pub. Date: Jul. 21, 2016

(65) Prior Publication Data

US 2017/0370338 A1 Dec. 28, 2017

(30) Foreign Application Priority Data

Jan. 15, 2015 (JP) ..... JP2015-6177

(51) Int. Cl.
*F02M 59/12* (2006.01)
*F04C 15/06* (2006.01)
(Continued)

(52) U.S. Cl.
CPC ..... *F02M 59/12* (2013.01); *F02M 37/10* (2013.01); *F04C 2/084* (2013.01); *F04C 2/086* (2013.01);
(Continued)

(58) Field of Classification Search
None
See application file for complete search history.

(56) References Cited

U.S. PATENT DOCUMENTS 2,484,789 A * 10/1949 Hill ..... F04C 2/102 418/21
3,658,444 A * 4/1972 Rhodes ..... F02M 37/08 417/423.3
(Continued)

FOREIGN PATENT DOCUMENTS

| | | | |
|---|---|---|---|
| JP | 11-13640 | * | 1/1999 |
| JP | 2008-274870 | | 11/2008 |
| JP | 2012-197709 | | 10/2012 |

OTHER PUBLICATIONS

International Search Report for PCT/JP2015/006357, dated Apr. 5, 2016, 2 pages.

*Primary Examiner* — Peter J Bertheaud
*Assistant Examiner* — Geoffrey S Lee
(74) *Attorney, Agent, or Firm* — Nixon & Vanderhye P.C.

(57) ABSTRACT

An inner gear includes: sliding surface parts that are provided annularly at an outer peripheral part including a plurality of outer teeth on both sides of the inner gear in its axial direction and that slide on a pump housing; recessed parts that are respectively provided radially inward of the sliding surface parts to respectively form fuel chambers, into which fuel flows, between the recessed parts and the pump housing; and a communication hole that communicates between the recessed parts. The inner gear further includes an inclined surface part that is provided at an edge portion of a communicating edge portion on a rotation advance side of the inner gear, to avoid an adjacent part adjacent to an inner peripheral edge portion of each of the sliding surface parts and that is inclined further toward a rear side in a direction to a central part of the communication hole.

8 Claims, 7 Drawing Sheets

(51) Int. Cl.

| | |
|---|---|
| ***F04C 2/10*** | (2006.01) |
| ***F04C 2/08*** | (2006.01) |
| ***F02M 37/10*** | (2006.01) |
| ***F04C 11/00*** | (2006.01) |
| ***F04C 15/00*** | (2006.01) |

(52) U.S. Cl.
CPC ..... *F04C 2/102* (2013.01); *F04C 11/008* (2013.01); *F04C 15/0065* (2013.01); *F04C 15/0088* (2013.01); *F04C 15/06* (2013.01); *F04C 15/008* (2013.01); *F04C 2210/203* (2013.01); *F04C 2240/30* (2013.01); *F04C 2240/40* (2013.01); *F04C 2240/60* (2013.01)

(56) References Cited

U.S. PATENT DOCUMENTS 4,445,820 A * 5/1984 Hayashi ..... F02M 37/08 415/170.1
4,573,882 A * 3/1986 Watanabe ..... F02M 37/08 417/366
4,718,827 A * 1/1988 Sutton ..... F02M 37/08 29/464
4,958,984 A * 9/1990 Aoi ..... F02M 37/08 403/355
5,006,048 A * 4/1991 Jow ..... F04C 15/0061 417/366
5,145,348 A * 9/1992 Zumbusch ..... F04C 15/0076 418/171
5,190,450 A * 3/1993 Ghosh ..... F01C 21/02 384/114
5,393,203 A * 2/1995 Hantle ..... F02M 37/08 417/203
5,562,433 A * 10/1996 Cholet ..... E21B 43/121 418/102
6,102,684 A * 8/2000 Tuckey ..... F02M 37/04 418/15
6,106,240 A * 8/2000 Fischer ..... F04C 2/102 417/203
8,215,932 B2 * 7/2012 O'Brien, II ..... F04C 2/10 418/128
9,212,660 B2 * 12/2015 Huser ..... F04C 2/3446
2003/0063991 A1 * 4/2003 Toyama ..... F01C 21/0872 418/93
2013/0089453 A1 4/2013 Ogata et al.

* cited by examiner

FUEL PUMP

CROSS REFERENCE TO RELATED APPLICATION

This application is U.S. national phase of International Application No. PCT/JP2015/006357 filed Dec. 21, 2015 which designated the U.S. and claims priority to Japanese Patent Application No. 2015-6177 filed on Jan. 15, 2015, the entire contents of each of which are hereby incorporated herein by reference.

TECHNICAL FIELD

The present disclosure relates to a fuel pump that draws fuel sequentially into pump chambers and then discharges fuel.

BACKGROUND ART

Patent Document 1 discloses a pump for the conventional art applicable to a fuel pump that draws fuel into a pump chamber and discharges fuel in succession. This pump includes an outer gear having inner teeth, an inner gear that includes outer teeth and is eccentric relative to the outer gear in an eccentric direction to be engaged with the outer gear, and a pump housing that rotatably accommodates the outer gear and the inner gear. The outer gear and the inner gear rotate to draw oil into the pump chambers and then discharge oil in succession, with the volume of the pump chambers formed between both these gears increased or decreased.

This inner gear includes sliding surface parts that are annularly provided respectively on both sides of the inner gear in its axial direction at the outer peripheral part of the inner gear including the outer teeth to slide on the pump housing, and recessed parts that are provided respectively inward of the sliding surface parts to form oil chambers, into which oil flows, with respect to the pump housing.

PRIOR ART DOCUMENT

Patent Document

Patent Document 1: JP2012-197709A

In the inner gear in Patent Document 1, it seems that the oil from the pump chamber leaks through the interface between the pump housing and the sliding surface part to flow in to accumulate in the recessed parts on both sides in the axial direction. However, when this configuration is applied to a fuel pump, the difference in amount of fuel leaked on both sides in the axial direction puts the fuel pressure in a fuel chamber between the recessed parts out of balance. Thus, friction is easily produced between the pump housing and the sliding surface part thereby to generate an adverse impact on pump efficiency.

SUMMARY OF INVENTION

The present disclosure addresses the above-described issues. Thus, it is an objective of the present disclosure to provide a fuel pump with high pump efficiency.

To achieve the objective, a fuel pump in an aspect of the present disclosure includes: an outer gear that includes a plurality of inner teeth; an inner gear that includes a plurality of outer teeth and is eccentric from the outer gear in an eccentric direction to be engaged with the outer gear; and a pump housing that rotatably accommodates the outer gear and the inner gear. The outer gear and the inner gear expand and contract volume of a plurality of pump chambers formed between both the gears, and rotate to sequentially suction fuel into the plurality of pump chambers. The inner gear includes: sliding surface parts that are provided annularly at an outer peripheral part including the plurality of outer teeth respectively on both sides of the inner gear in an axial direction of the inner gear and that slide on the pump housing; recessed parts that are respectively provided radially inward of the sliding surface parts to respectively form fuel chambers, into which fuel flows, between the recessed parts and the pump housing; and a communication hole that communicates between the recessed parts. An edge portion of an opening of the communication hole that communicates with each of the recessed parts is a communicating edge portion. The inner gear further includes an inclined surface part that is provided at an edge portion of the communicating edge portion on a rotation advance side of the inner gear, to avoid an adjacent part adjacent to an inner peripheral edge portion of each of the sliding surface parts and that is inclined further toward a rear side in a direction to a central part of the communication hole.

In this aspect, in the inner gear in which the sliding surface parts and the recessed parts respectively inward of the sliding surface parts are provided on both sides in the axial direction, the communication holes communicate between these recessed parts. Fuel can flow between the fuel chambers defined by the respective recessed parts by these communication holes thereby to keep pressure balance between on both sides of the inner gear in the axial direction. The inclined surface part that is inclined further toward the rear side in the direction to the central part of the communication hole is provided at the edge portion of the communicating edge portion of the communication hole on the rotation advance side of the inner gear. At the time of rotation of the inner gear, this inclined surface part guides fuel into the communication hole to promote the flowage of fuel, thereby forming a liquid film lubrication condition. Moreover, this inclined surface part is provided to be clear of the adjacent part that is adjacent to the inner peripheral edge portion of the sliding surface part, so that the fuel from the pump chambers cannot leak too much. This can restrain the sliding loss between the pump housing and the sliding surface to provide the fuel pump with high pump efficiency.

BRIEF DESCRIPTION OF DRAWINGS

The above and other objects, features and advantages of the present disclosure will become more apparent from the following detailed description made with reference to the accompanying drawings. In the drawings.

EMBODIMENT FOR CARRYING OUT INVENTION

An embodiment will be described below with reference to the accompanying drawings.

Figure 1:
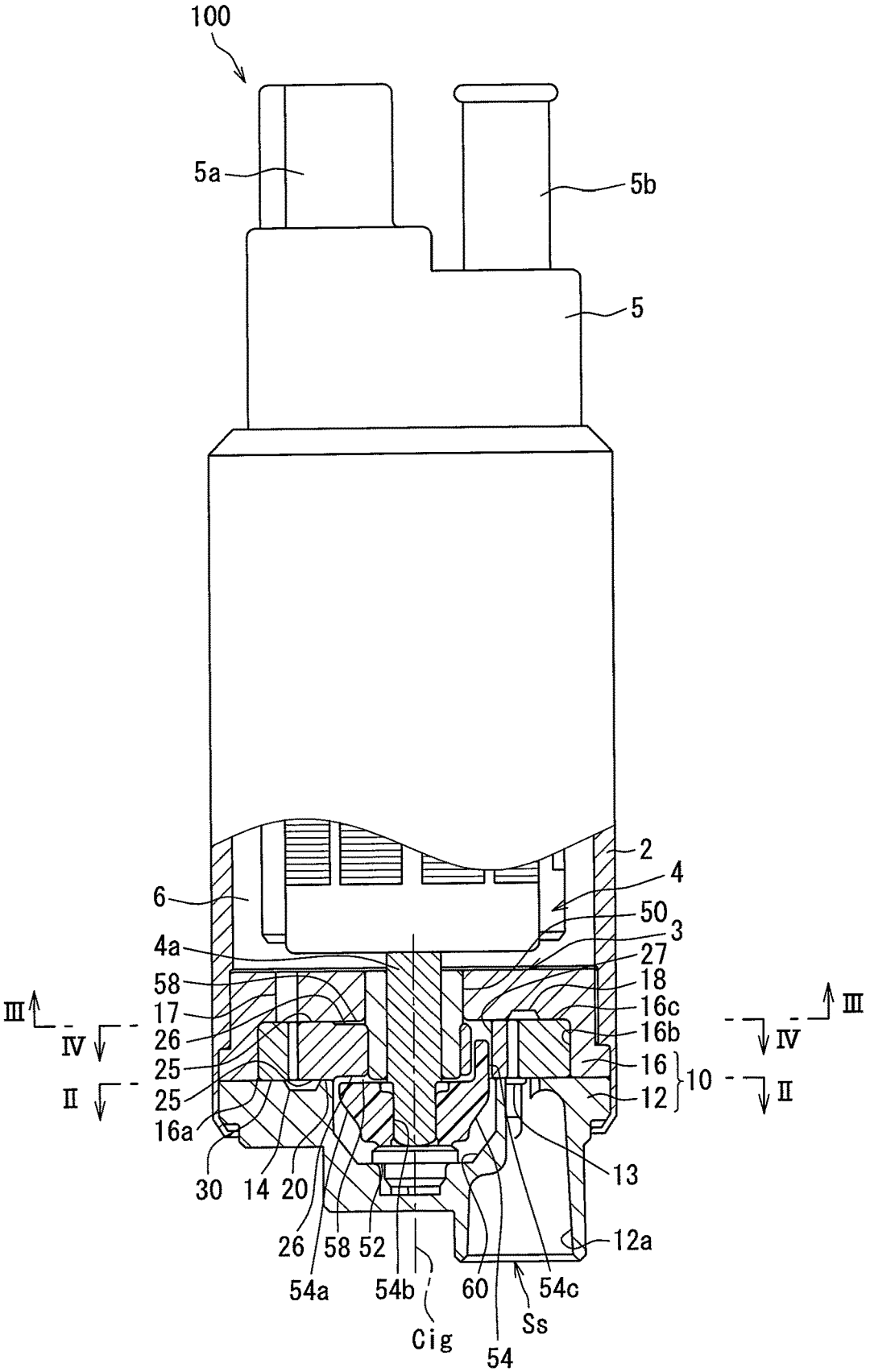
FIG. 1 is a front view illustrating a partial section of a fuel pump in accordance with an embodiment.

As illustrated in FIG. 1, a fuel pump 100 of the embodiment is a positive displacement trochoid pump disposed in a vehicle. The fuel pump 100 includes a pump main body 3 and an electric motor 4, which are accommodated in a cylindrical pump body 2. The fuel pump 100 includes a side cover 5 that projects outward from the end of the pump body 2 on an opposite side of the electric motor 4 from the pump main body 3 in the axial direction. The side cover 5 includes an electric connector 5*a* for energization of the electric motor 4, and a discharge port 5*b* through which to discharge fuel. In this fuel pump 100, the electric motor 4 is rotated by the energization from an external circuit through the electric connector 5*a*. Consequently, the fuel drawn and pressurized by the pump main body 3 using the rotation force of a rotation shaft 4*a* of the electric motor 4 is discharged from the discharge port 5*b*. The fuel pump 100 discharges light oil having higher viscosity than gasoline as fuel.

The present embodiment employs an inner-rotor type brushless motor for the electric motor 4. When actuated, this electric motor 4 is rotated reversely from a normal rotation direction (i.e., rotated in a reverse direction from a rotation direction Rig described later).

In the following description, a rotation advance side means a side which is a positive direction in the rotation direction Rig. A rotation reverse side means a side which is a negative direction in the rotation direction Rig.

The pump main body 3 will be described in detail below. The pump main body 3 includes a pump housing 10, an inner gear 20, and an outer gear 30. The pump housing 10 is obtained by stacking a pump cover 12 and a pump case 16.

The pump cover 12 is formed from metal in a disc shape. The pump cover 12 projects outward from the end of the pump body 2 on an opposite side of the electric motor 4 from the side cover 5 in the axial direction.

Figure 2:
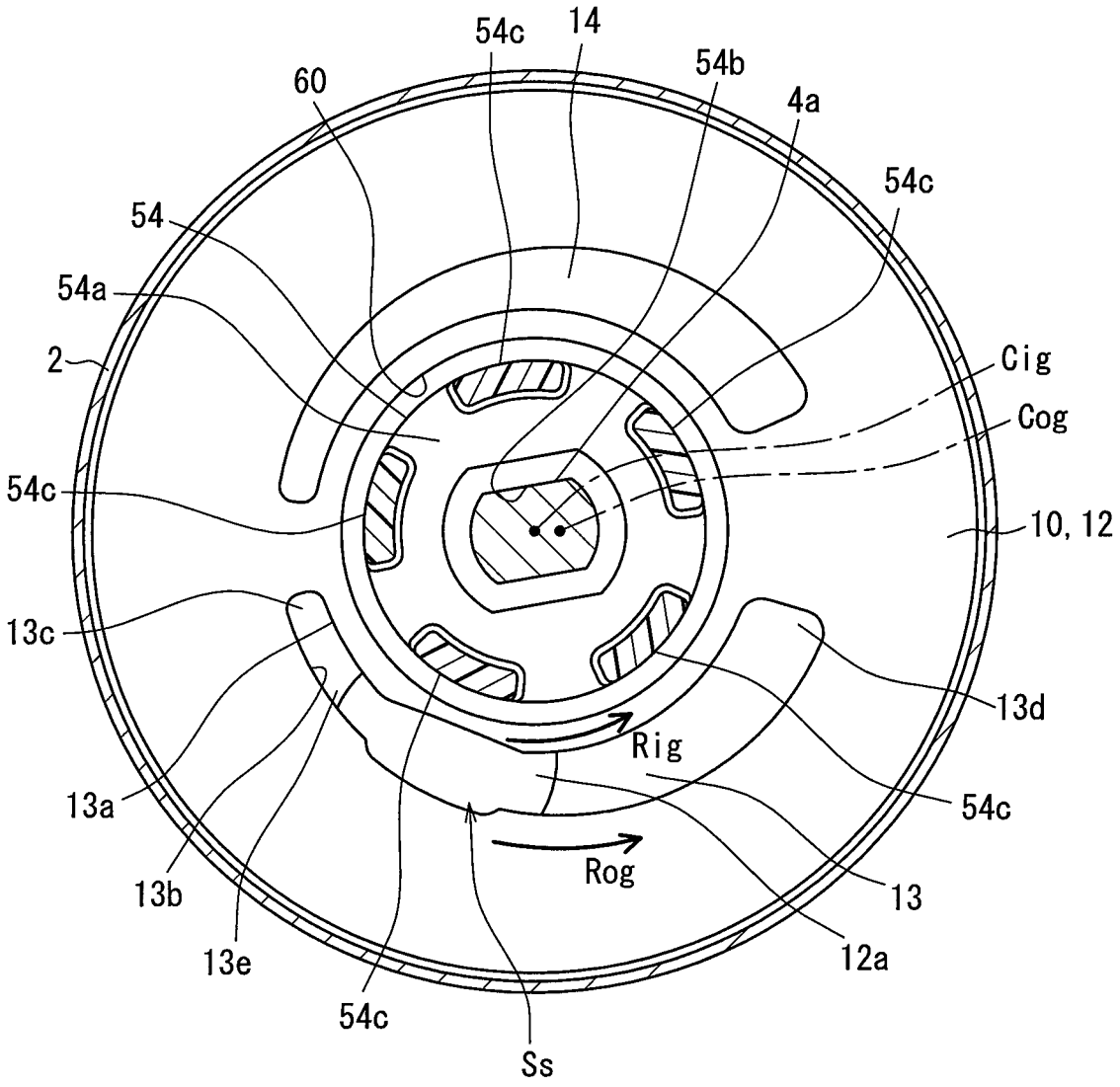
FIG. 2 is a cross-sectional view taken along a line II-II in FIG. 1.

The pump cover 12 illustrated in FIGS. 1 and 2 includes a suction port 12*a* having a cylindrical hole shape, and a suction passage 13 having a circular arc groove shape, for drawing in fuel from the outside. The suction port 12*a* passes through a particular part Ss of the pump cover 12 that is eccentric from the inner central line Cig of the inner gear 20 along the axial direction of the pump cover 12. The suction passage 13 opens on the pump case 16-side of the pump cover 12. As illustrated in FIG. 2, an inner peripheral part 13*a* of the suction passage 13 extends to have a length smaller than half a circumference along the rotation direction Rig of the inner gear 20 (see also FIG. 4). An outer peripheral part 13*b* of the suction passage 13 extends to have a length smaller than half a circumference along a rotation direction Rog of the outer gear 30 (see also FIG. 4).

The suction passage 13 is further widened from a starting end part 13*c* toward a terminal part 13*d* in the rotation directions Rig, Rog. The suction port 12*a* opens at the particular part Ss of a groove bottom part 13*e*, so that the suction passage 13 communicates with the suction port 12*a*. Particularly, as illustrated in FIG. 2, in the entire region of the particular part Ss at which the suction port 12*a* opens, the width of the suction passage 13 is set to be smaller than the diameter of the suction port 12*a*.

Figure 3:
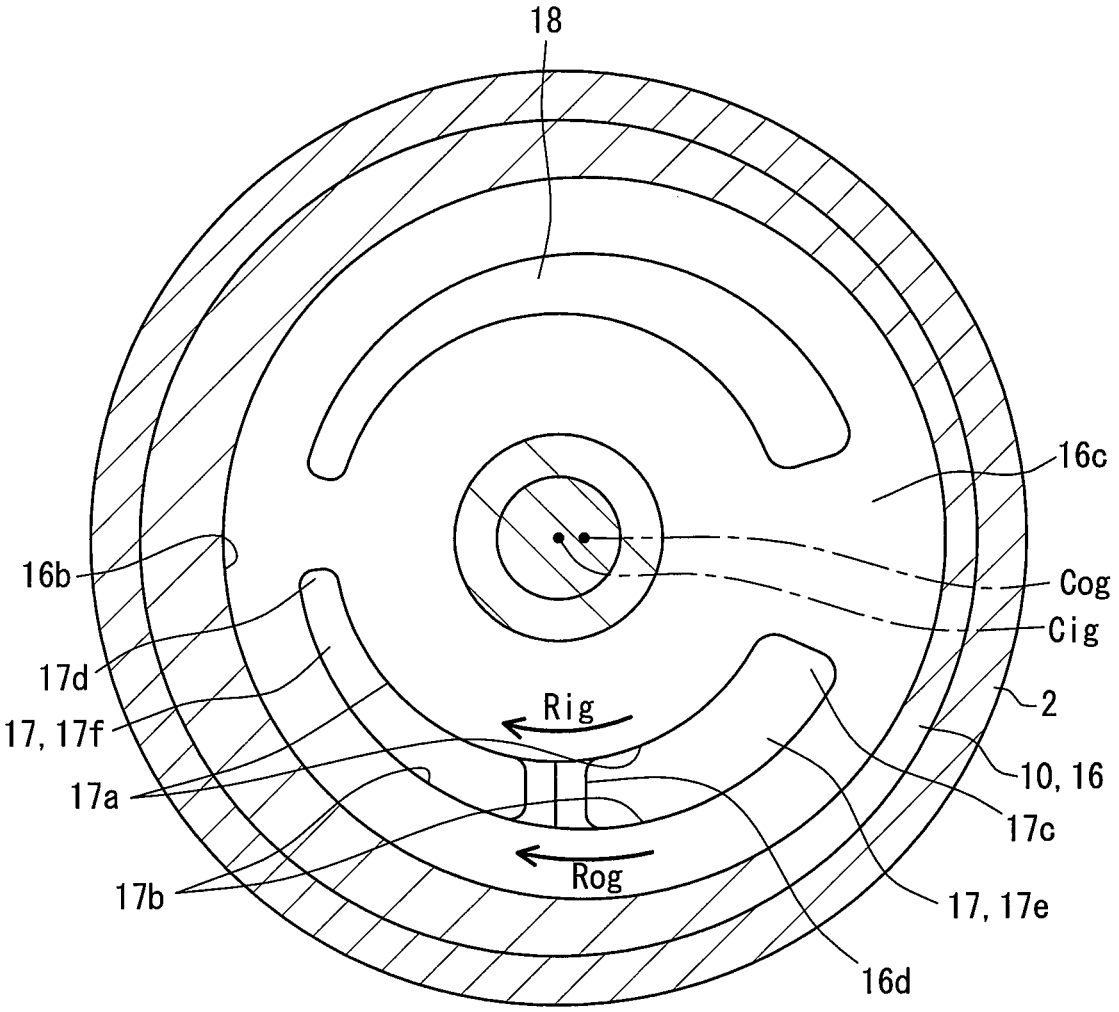
FIG. 3 is a cross-sectional view taken along a line III-Ill in FIG. 1.
Figure 4:
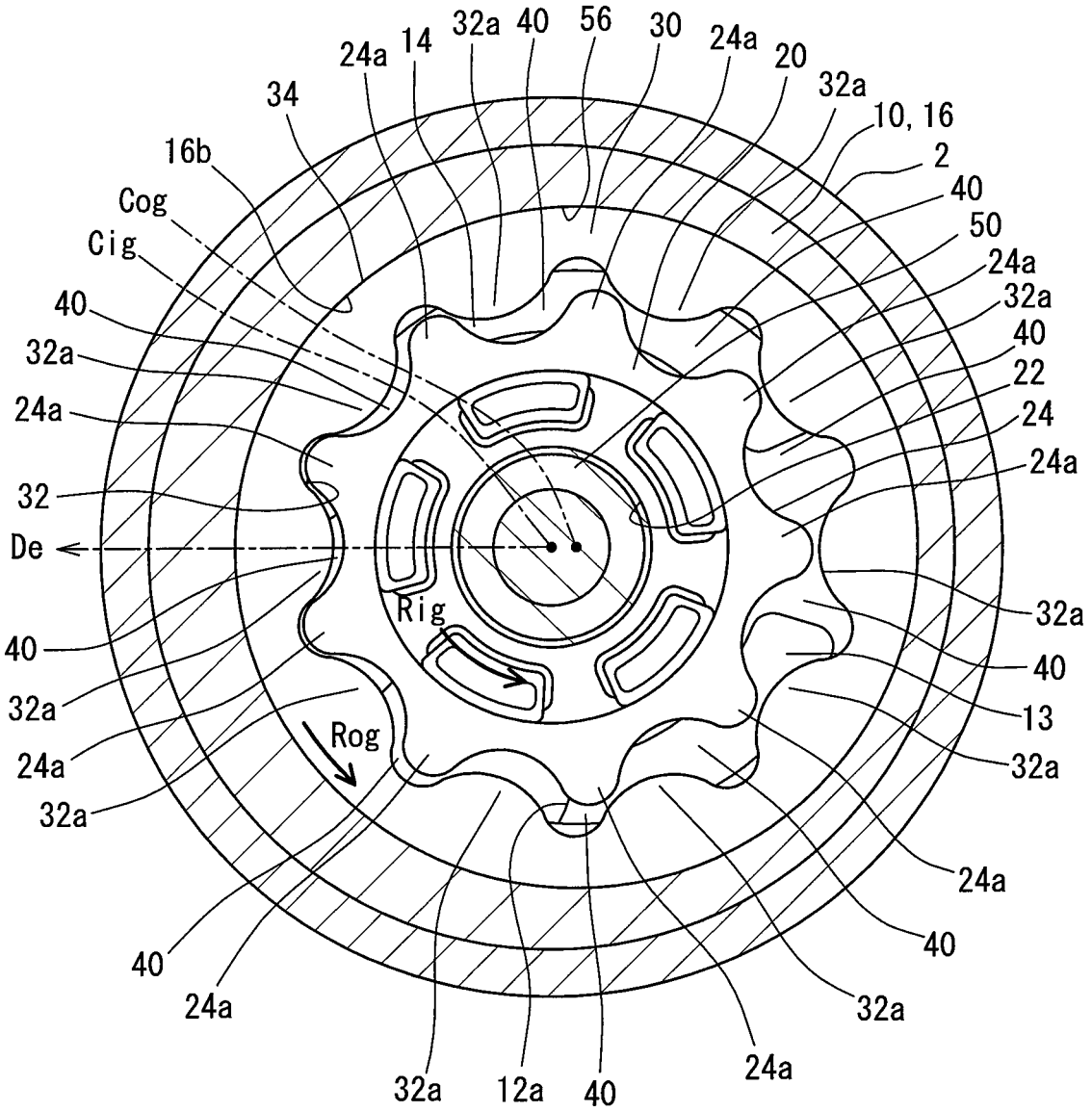
FIG. 4 is a cross-sectional view taken along a line IV-IV in FIG. 1.

The pump case 16 illustrated in FIGS. 1, 3, and 4 is formed from metal in a cylindrical shape having a bottom. An opening part 16*a* of the pump case 16 is covered by the pump cover 12 to be sealed along the entire circumference. As illustrated particularly in FIGS. 1 and 4, an inner peripheral part 16*b* of the pump case 16 is formed in a cylindrical hole shape that is eccentric from the inner central line Cig of the inner gear 20.

The pump case 16 includes a discharge port 17 having an arc hole shape to discharge fuel from the discharge port 5*b* through a fuel passage 6 between the pump body 2 and the electric motor 4. The discharge port 17 passes through a recessed bottom part 16*c* of the pump case 16 along the axial direction. In other words, the recessed bottom part 16*c* is provided at the part adjacent to the discharge port 17. As illustrated particularly in FIG. 3, an inner peripheral part 17*a* of the discharge port 17 extends to have a length smaller than half a circumference along the rotation direction Rig of the inner gear 20. An outer peripheral part 17*b* of the discharge port 17 extends to have a length smaller than half a circumference along the rotation direction Rog of the outer gear 30. The width of the discharge port 17 is further reduced from a starting end part 17*c* toward a terminal part 17*d* in the rotation directions Rig, Rog.

The pump case 16 includes a reinforcing rib 16*d* in the discharge port 17. One reinforcing rib 16*d* of the present embodiment is provided generally at the center of the discharge port 17. The reinforcing rib 16*d* is a rib that is formed from metal integrally with the pump case 16 and that crosses the discharge port 17 in a cross direction that crosses the rotation direction Rig of the inner gear 20 to reinforce the pump case 16. Specifically, the reinforcing rib 16*d* restricts the deformation of the pump case 16 in the direction crossing the discharge port 17, which extends along the rotation direction Rig. The discharge port 17 is divided by this reinforcing rib 16*d* between a starting end side passage 17*e* and a terminal side passage 17*f*. The discharge port 17 communicates with the fuel passage 6 illustrated in FIG. 1 at both the starting end side passage 17*e* and the terminal side passage 17*f*.

At the portion of the recessed bottom part 16*c* of the pump case 16 that is opposed to the suction passage 13 with a pump chamber 40 (described in detail later) between both the gears 20 and 30 located therebetween, as illustrated particularly in FIG. 3, a suction groove 18 having a circular arc groove shape is formed corresponding to the shape of the suction passage 13 projected in the axial direction. Consequently, in the pump case 16, the outline of the discharge port 17 is provided to be symmetrical to the suction groove 18 with respect to a line. On the other hand, at the portion of the pump cover 12 that is opposed to the discharge port 17 with the pump chamber 40 located therebetween as illustrated particularly in FIG. 2, a discharge groove 14 having a circular arc groove shape is formed corresponding to the shape of the discharge port 17 projected in the axial direction. Consequently, in the pump cover 12, the suction passage 13 is provided to be line-symmetrical to the discharge groove 14.

As illustrated in FIG. 1, a radial bearing 50 is fitted and fixed to the recessed bottom part 16*c* of the pump case 16 on the inner central line Cig to radially bear the rotation shaft 4*a* of the electric motor 4. On the other hand, a thrust bearing 52 is fitted and fixed to the pump cover 12 on the inner central line Cig to axially bear the rotation shaft 4*a*.

As illustrated in FIGS. 1 and 4, in collaboration with the pump cover 12, the recessed bottom part 16*c* and the inner peripheral part 16*b* of the pump case 16 define an accommodating space 56 that accommodates the inner gear 20 and the outer gear 30. The inner gear 20 and the outer gear 30 are "trochoid gears" with the tooth shape curves of their respective teeth assuming a trochoid curve.

The inner gear 20 is disposed eccentrically in the accommodating space 56 with the inner gear 20 and the rotation shaft 4*a* having the inner central line Cig in common. In accordance with the rotation of the rotation shaft 4*a* by the electric motor 4, the inner gear 20 can rotate in the constant rotation direction Rig around the inner central line Cig.

The inner gear 20 includes outer teeth 24*a*, which are arranged side by side at regular intervals in this rotation direction Rig, at its outer peripheral part 24. The respective outer teeth 24*a* can be axially opposed to the discharge port 17, the suction passage 13, and the grooves 14, 18 in accordance with the rotation of the inner gear 20. Consequently, sticking of the outer teeth 24*a* to the recessed bottom part 16*c* and the pump cover 12 is limited.

The outer gear 30 is eccentric relative to the inner central line Cig of the inner gear 20 to be located coaxially in the accommodating space 56. Consequently, the inner gear 20 is eccentric relative to the outer gear 30 in an eccentric direction De as one radial direction. An outer peripheral part 34 of the outer gear 30 is radially borne by the inner peripheral part 16*b* of the pump case 16, and is axially borne by the recessed bottom part 16*c* of the pump case 16 and the pump cover 12. Because of these bearings, the outer gear 30 can rotate in the constant rotation direction Rog around an outer central line Cog that is eccentric from the inner central line Cig.

The outer gear 30 includes inner teeth 32*a*, which are arranged side by side at regular intervals in this rotation direction Rog, at its inner peripheral part 32. The number of inner teeth 32*a* of the outer gear 30 is set to be more than the number of outer teeth 24*a* of the inner gear 20 by one tooth. The respective inner teeth 32*a* can be axially opposed to the discharge port 17, the suction passage 13, and the grooves 14, 18 in accordance with the rotation of the outer gear 30. Consequently, sticking of the inner teeth 32*a* to the recessed bottom part 16*c* and the pump cover 12 is limited.

As illustrated in FIG. 4, the inner gear 20 is engaged with the outer gear 30 due to its eccentricity relative to the outer gear 30 in the eccentric direction De. Consequently, the pump chambers 40 are continuously formed between both the gears 20 and 30 in the accommodating space 56. The volume of this pump chamber 40 is expanded or contracted by the rotation of the outer gear 30 and the inner gear 20.

The volume of the pump chamber 40 that is opposed to and communicates with the suction passage 13 and the suction groove 18 increases in accordance with the rotation of both the gears 20 and 30. As a consequence, fuel is drawn into the pump chamber 40 through the suction passage 13 from the suction port 12*a*. In this case, the suction passage 13 is further widened from the starting end part 13*c* toward the terminal part 13*d* (see also FIG. 2). Thus, the amount of fuel drawn in through the suction passage 13 accords with the volume expansion amount of the pump chamber 40.

The volume of the pump chamber 40 that is opposed to and communicates with the discharge port 17 and the discharge groove 14 decreases in accordance with the rotation of both the gears 20 and 30. As a consequence, fuel is discharged from the pump chamber 40 into the fuel passage 6 through the discharge port 17 at the same time as the above suction function. In this case, the width of the discharge port 17 is further reduced from the starting end part 17*c* toward the terminal part 17*d* (see also FIG. 3). Thus, the amount of fuel discharged through the discharge port 17 accords with the volume contraction amount of the pump chamber 40.

In this manner, fuel is suctioned sequentially into the pump chambers 40 and is discharged from the pump chambers 40 into the discharge port 17 by the fuel pump 100.

Figure 5:
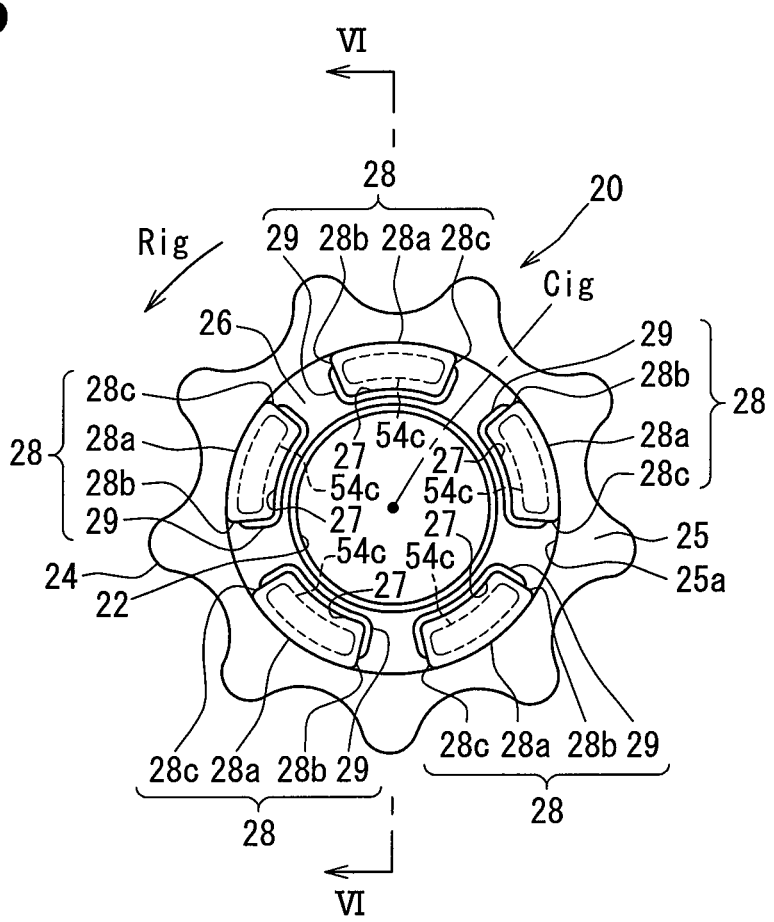
FIG. 5 is a diagram illustrating an inner gear viewed from a housing space side according to the embodiment.
Figure 6:
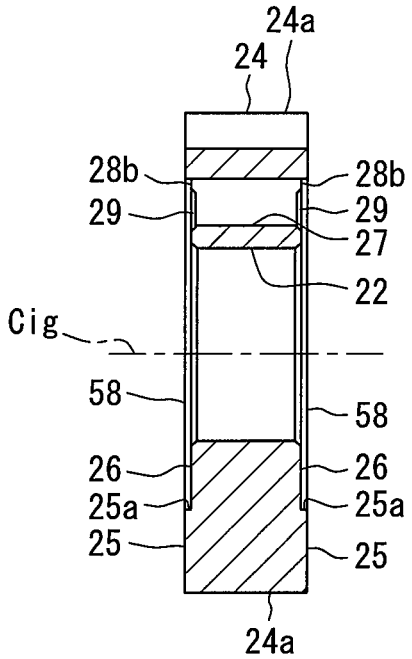
FIG. 6 is a sectional view taken along a line VI-VI in FIG. 5.

Peripheral configurations of the inner gear 20 will be described in detail. As illustrated in FIGS. 5 and 6, the inner gear 20 includes sliding surface parts 25, recessed parts 26, communication holes 27, and inclined surface parts 29.

The sliding surface parts 25 are sealing surfaces that are provided at the outer peripheral part 24 including the outer teeth 24*a* annularly and in a planar shape along the entire circumference respectively on both sides of the inner gear 20 in the axial direction. Due to the rotation of the inner gear 20, which is accommodated in the accommodating space 56 defined by the pump housing 10, in the rotation direction Rig, the sliding surface part 25 on the electric motor 4-side in the axial direction slides on the recessed bottom part 16*c* of the pump case 16 (see also FIG. 1). Due to the rotation of the inner gear 20 in the rotation direction Rig, the sliding surface part 25 on an opposite side of the inner gear 20 from the electric motor 4 in the axial direction slides on the pump cover 12 (see also FIG. 1).

The recessed parts 26 are provided in a ring shape respectively inward of the sliding surface parts 25. The recessed part 26 on the electric motor 4-side is recessed on an opposite side from the electric motor 4 inward of its corresponding sliding surface part 25 in the inner gear 20 to form a space between the recessed part 26 and the pump case 16. The recessed part 26 on the opposite side from the electric motor 4 is recessed on the electric motor 4-side inward of its corresponding sliding surface part 25 in the inner gear 20 to form a space between the recessed part 26 and the pump cover 12. These spaces are configured as fuel chambers 58 into which the light oil as fuel leaked out through the sliding surface parts 25 from the pump chambers 40 flows.

The communication hole 27 is a hole that passes through the inner gear 20 along the axial direction and that communicates between the bottoms of the recessed parts 26 on both sides in the axial direction. In the present embodiment, more than one communication hole 27 are provided corresponding to leg parts 54*c* of a joint member 54 described later, and specifically, five communication holes 27 are provided. The communication holes 27 are provided at regular intervals along the rotation direction Rig of the inner gear 20. The cross sectional shape of each communication hole 27 is a generally sectoral and partially annular shape. Communicating edge portions 28, which are the edge portions of the openings of the communication holes 27 that communicates with the recessed part 26, are partly adjacent at adjacent parts 28*a*, 28*b*, 28*c* of an inner peripheral edge portion 25*a* of the sliding surface part 25. Particularly, the side of the adjacent parts 28*a*, 28*b*, 28*c* that is provided entirely along the inner peripheral edge portion 25*a* is hereinafter referred to as an adjacent side 28*a*.

The inclined surface parts 29 are provided respectively at the communicating edge portions 28 of the openings of the communication holes 27 on both sides in the axial direction. Each inclined surface part 29 is provided at a part of its corresponding communicating edge portion 28, and is inclined further toward the rear side in a direction to the central part of the communication hole 27. The rear side means the side away from the bottom of the recessed part 26 in the communication hole 27. The inclined surface part 29 of the present embodiment is formed in a flat surface shape, but may be formed in a projecting or recessed bent surface shape.

More detailed explanation will be given with a focus on one of the inclined surface parts 29 of the present embodiment. The inclined surface part 29 is formed at the edge portion of the communicating edge portion 28 on the rotation advance side of the inner gear 20, to be clear of the adjacent part 28*b* that is adjacent to the inner peripheral edge portion 25*a*. Furthermore, the inclined surface part 29 is formed at the edge portion of the communicating edge portion 28 on the rotation reverse side of the inner gear 20, to be clear of the adjacent part 28*c* that is adjacent to the inner peripheral edge portion 25*a*. In addition, the inclined surface part 29 is also provided at the edge portion on an opposite side of the opening of the communication hole 27 from the adjacent side 28*a* of the adjacent parts. In other words, the inclined surface parts 29 are provided continuously for the three sides of the communicating edge portion 28 on the rotation shaft 4*a*-side except the adjacent side 28*a*. The same holds for each inclined surface part 29.

As illustrated in FIG. 1, an inner peripheral part 22 of this inner gear 20 is radially borne by the radial bearing 50, and is axially borne by the recessed bottom part 16*c* of the pump case 16 and the pump cover 12. The inner gear 20 is connected to the rotation shaft 4*a* via the joint member 54.

Figure 7:
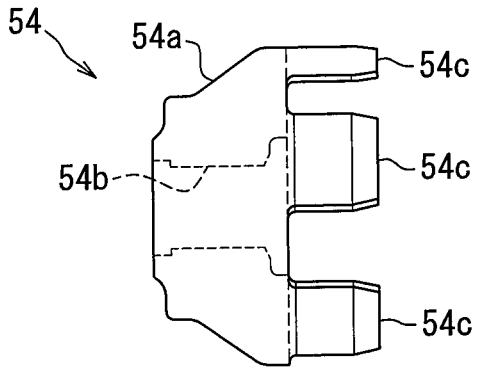
FIG. 7 is a front view illustrating a joint member according to the embodiment.

The joint member 54 illustrated in FIGS. 1, 2, and 7 is housed in a housing space 60 of the pump cover 12 having a recessed opening shape that is formed to communicate with the recessed part 26 on the opposite side from the electric motor 4. The joint member 54 is formed from synthetic resin such as polyphenylene sulfide resin, and includes a fitting part 54*a* and the leg parts 54*c* which can bend. The fitting part 54*a* is formed in an annular shape at whose center a fitting hole 54*b* opens, and the rotation shaft 4*a* is inserted through this fitting hole 54*b*, so that the fitting part 54*a* is fitted and fixed to the rotation shaft 4*a*. Each leg part 54*c* projects from the fitting part 54*a* toward the inner gear 20 in the axial direction. Specifically, five leg parts 54*c* are provided corresponding to the number of communication holes 27. Each leg part 54*c* is inserted in a corresponding one of the communication holes 27 with a clearance therebetween.

In this manner, the joint member 54 connects the rotation shaft 4*a* to the inner gear 20 via the leg parts 54*c*, and the inner gear 20 is rotated by the rotation of the rotation shaft 4*a*.

The operation and effects of the above-described present embodiment will be described below.

In the inner gear 20 of the present embodiment, in which the sliding surface parts 25 and the recessed parts 26 respectively inward of the sliding surface parts 25 are provided on both sides of the inner gear 20 in the axial direction, the communication holes 27 communicate between these recessed parts 26. Fuel can flow between the fuel chambers 58 defined by the respective recessed parts 26 by these communication holes 27 thereby to keep pressure balance between on both sides of the inner gear 20 in the axial direction. The inclined surface part 29 that is inclined further toward the rear side in the direction to the central part of the communication hole 27 is provided at the edge portion of the communicating edge portion 28 of the communication hole 27 on the rotation advance side of the inner gear 20. At the time of rotation of the inner gear 20, this inclined surface part 29 guides fuel into the communication hole 27 to promote the flowage of fuel, thereby forming a liquid film lubrication condition. Moreover, this inclined surface part 29 is provided to be clear of the adjacent part 28*b* that is adjacent to the inner peripheral edge portion 25*a* of the sliding surface part 25, so that the fuel from the pump chambers 40 cannot leak too much. This can restrain the sliding loss between the pump housing 10 and the sliding surface part 25 to provide the fuel pump 100 with high pump efficiency.

The inclined surface part 29 of the present embodiment is provided at the edge portion of the communication hole 27 on the rotation reverse side of the inner gear 20 to be clear of the adjacent part 28*c*. In this manner, by providing the inclined surface part 29 also at the edge portion on the rotation reverse side, fuel flows into the communication hole 27 even more easily to increase the flow rate and to easily form the liquid film lubrication condition. Thus, the fuel pump 100 with high pump efficiency can be provided.

The inclined surface part 29 of the present embodiment is provided at the edge portion of the communication hole 27 on the opposite side of the opening from the adjacent side 28*a* of the adjacent parts. In this manner, by providing the inclined surface part 29 also at the edge portion on the opposite side from the adjacent part, fuel flows into the communication hole 27 even more easily to increase the flow rate and to easily form the liquid film lubrication condition. Thus, the fuel pump 100 with high pump efficiency can be provided.

The inclined surface parts 29 of the present embodiment are provided at the communicating edge portions 28 of the openings on both sides that communicate respectively with the recessed parts 26. By providing the inclined surface parts 29 on both sides, the inflow and outflow of fuel through the communication hole 27 is more opened to reliably keep the pressure balance between on both sides in the axial direction and to easily form the liquid film lubrication condition. Thus, the fuel pump 100 with high pump efficiency can be provided.

The communication holes 27 of the present embodiment are provided along the rotation direction Rig of the inner gear 20. The liquid film is formed uniformly by fuel flowing through these communication holes 27. Thus, the pressure balance between on both sides of the inner gear 20 in the axial direction is maintained at each part in the rotation direction Rig, so that one-side uneven wear can be inhibited. Thus, the fuel pump 100 with high pump efficiency can be provided.

In the present embodiment, the leg parts 54*c* of the joint member 54, to which the rotation shaft 4*a* of the electric motor 4 is connected, are inserted respectively in the communication holes 27 with respective clearances between the leg parts 54*c* and the communication holes 27. When the rotation shaft 4*a* is shifted, this shaft shifting can be absorbed using the clearance of the communication hole 27. The inner gear 20 can be rotated in a balanced manner by the absorption of the shaft shifting. Additionally, the flow of fuel using this clearance can form the liquid film lubrication condition thereby to provide the fuel pump 100 with high pump efficiency.

The pump housing 10 of the present embodiment includes the housing space 60 that communicates with one recessed part 26 to house the joint member 54. The one recessed part 26 communicating with this housing space 60 and the other recessed part 26 are connected through the communication holes 27. Thus, the pressure balance between on both sides of the inner gear 20 in the axial direction is maintained, so that the pump efficiency can be increased.

The fuel of the present embodiment is light oil. The light oil has high viscosity, but the light oil flows easily into the communication hole 27 when the inclined surface part 29 is formed at the communicating edge portion 28, which is an inlet of the communication hole 27. Thus, the pump efficiency can be increased relatively easily.

The embodiment has been described above. The present disclosure is not interpreted by limiting to this embodiment, and can be applied to various embodiments without departing from the scope of the disclosure. Modifications to the above embodiment will be described below.

Figure 8:
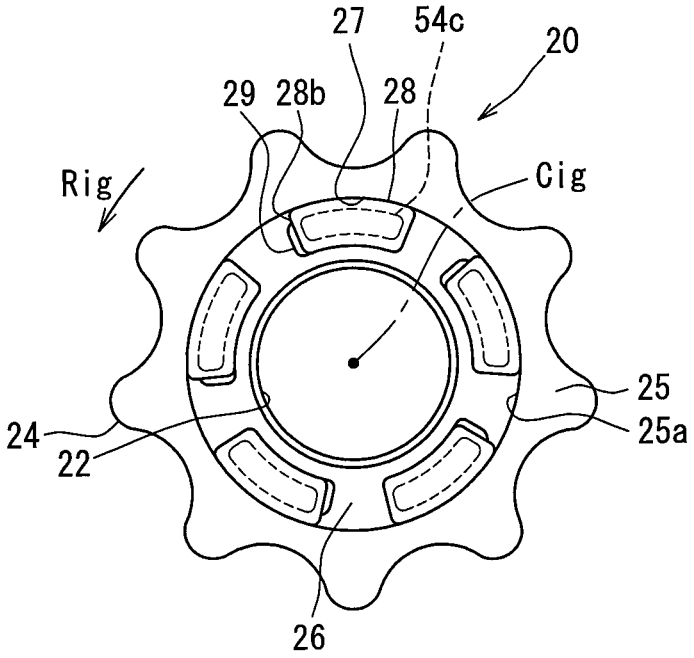
FIG. 8 is a diagram corresponding to FIG. 5 in an example in accordance with a first modification.
Figure 9:
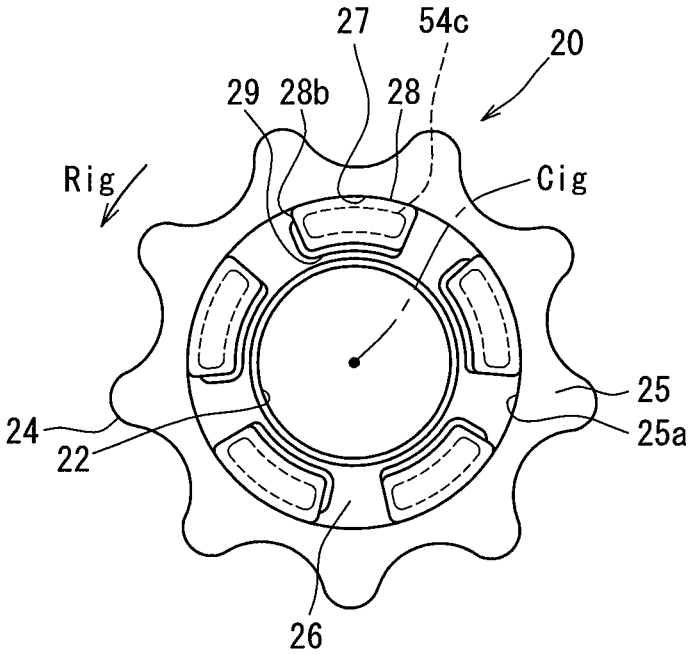
FIG. 9 is a diagram corresponding to FIG. 5 in an example of the first modification.
Figure 10:
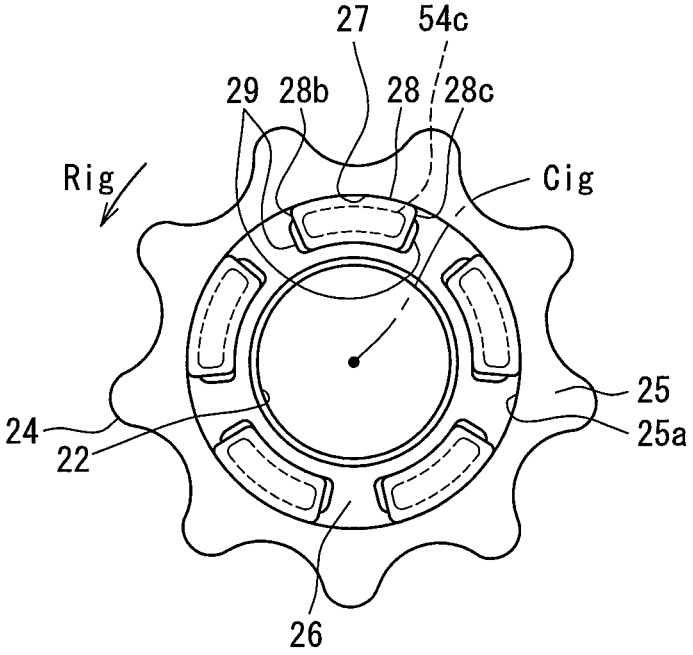
FIG. 10 is a diagram corresponding to FIG. 5 in an example of the first modification.

Specifically, various modes can be employed for the inclined surface part 29 in a first modification as long as the inclined surface part 29 is provided at the edge portion of the communicating edge portion 28 on the rotation advance side of the inner gear 20, to avoid the adjacent part 28*b* that is adjacent to the inner peripheral edge portion 25*a* of the sliding surface part 25. For example, as illustrated in FIGS. 8 and 9, the inclined surface part 29 does not need to be provided at the edge portion of the communicating edge portion 28 on the rotation reverse side of the inner gear 20. For example, as illustrated in FIGS. 8 and 10, the inclined surface part 29 does not need to be provided at the edge portion of the communicating edge portion 28 on an opposite side of the opening from the adjacent side 28*a* of the adjacent parts.

The inclined surface part 29 in a second modification may be provided at the communicating edge portions 28 of the openings on one side communicating respectively with the recessed parts 26. As this example, the inclined surface parts 29 may be provided respectively at the communicating edge portions 28 on the housing space 60-side of both sides in the axial direction.

A shape such as a round shape, a rectangular shape, or a triangular shape may be employed for the cross sectional shape of the communication hole 27 in a third modification.

The communicating edge portion 28 in a fourth modification may be adjacent to the inner peripheral edge portion 25*a* of the sliding surface part 25 with a certain clearance therebetween.

In a fifth modification, the leg part 54*c* of the joint member 54 does not need to be inserted in the communication hole 27.

In a sixth modification, the inner gear 20 may be connected directly to the rotation shaft 4*a* instead of being connected to the rotation shaft 4*a* via the joint member 54.

In a seventh modification, a single communication hole 27 may be provided.

The fuel pump 100 in an eighth modification may suction and discharge gasoline other than light oil, or liquid fuel equivalent thereto, as its fuel.

While the present disclosure has been described with reference to embodiments thereof, it is to be understood that the disclosure is not limited to the embodiments and constructions. The present disclosure is intended to cover various modification and equivalent arrangements. In addition, the various combinations and configurations, other combinations and configurations, including more, less or only a single element, are also within the spirit and scope of the present disclosure.

The invention claimed is:

1. A fuel pump comprising:

an outer gear that includes a plurality of inner teeth;

an inner gear that includes a plurality of outer teeth and is eccentric from the outer gear in an eccentric direction to be engaged with the outer gear; and a pump housing that rotatably accommodates the outer gear and the inner gear, wherein:

the outer gear and the inner gear expand and contract volume of a plurality of pump chambers formed between both the gears, and rotate to sequentially suction fuel into the plurality of pump chambers and then discharge fuel from the plurality of pump chambers;

the inner gear includes:

sliding surfaces that are annular and at an outer peripheral part including the plurality of outer teeth respectively, that are on both axial sides of the inner gear, and that slide on the pump housing;

recessed parts that are radially inward of the sliding surfaces and that form fuel chambers, into which fuel flows, between the recessed parts and the pump housing; and a communication hole that communicates between the recessed parts; wherein an edge portion of an opening of the communication hole includes an inclined surface on a rotation advance side of the inner gear, but not extending beyond a part of the edge portion adjacent to an inner peripheral edge portion of each of the sliding surfaces, and a first portion of the inclined surface is inclined away from a bottom of the recessed part and toward a central part of the communication hole, and a second portion of the inclined surface extends in parallel with an inner central line of the inner gear along its axial direction.

2. The fuel pump according to claim 1, wherein the inclined surface is also on a rotation reverse side of the inner gear but not extending beyond the part of the edge portion adjacent to the inner peripheral edge portion of each of the sliding surfaces.

3. The fuel pump according to claim 1, wherein the inclined surface is also on an opposite side of the opening from the inner peripheral edge portion.

4. The fuel pump according to claim 1, wherein the inclined surface is provided at the opening of the communication hole on both sides that communicate respectively with the recessed parts.

5. The fuel pump according to claim 1, wherein the communication hole is one of a plurality of communication holes that are provided along a rotation direction of the inner gear.

6. The fuel pump according to claim 5, further comprising:

an electric motor that includes a rotation shaft, which rotates the inner gear; and a joint member that connects the rotation shaft with the inner gear via leg parts respectively corresponding to the plurality of communication holes, wherein each of the leg parts of the joint member is inserted in a corresponding one of the plurality of communication holes with a clearance therebetween.

7. The fuel pump according to claim 6, wherein the pump housing includes a housing space that communicates with one of the recessed parts to house the joint member.

8. The fuel pump according to claim 1, wherein light oil as fuel flows into the recessed parts.

* * * * *